United States Patent [19]

Lante-Montefeltro

[11] 4,274,636

[45] Jun. 23, 1981

[54] FLYING TARGET PIGEONS

[76] Inventor: Ludovico Lante-Montefeltro, Avda. Libertador Edif-Siclar., 2° Piso, Ofic. No. 23, Caracas, Venezuela

[21] Appl. No.: 882,907

[22] Filed: Mar. 1, 1978

Related U.S. Application Data

[63] Continuation-in-part of Ser. No. 604,069, Aug. 12, 1975, abandoned, Ser. No. 679,135, Apr. 21, 1976, Pat. No. 4,077,384, and Ser. No. 762,019, Jan. 24, 1977, Pat. No. 4,133,532.

[51] Int. Cl.[2] ..... F41J 9/16

[52] U.S. Cl. ..... 273/365

[58] Field of Search ..... 273/105.4, 105.6, 106 R, 273/106 B; 46/74 D, 82–84; 24/73 P

[56] References Cited

U.S. PATENT DOCUMENTS

| | | | |
|---|---|---|---|
| 3,176,988 | 4/1965 | Ferdinando | 273/105.4 |
| 3,675,926 | 7/1972 | Misevich | 273/105.4 |
| 3,851,357 | 12/1974 | Ribich et al. | 24/73 P |
| 3,853,319 | 12/1974 | Swanson | 273/105.4 |

FOREIGN PATENT DOCUMENTS

| | | | |
|---|---|---|---|
| 464422 | 7/1951 | Italy | 273/105.4 |

OTHER PUBLICATIONS

"American Rifleman"; Oct. 1968; pp. 76 and 78.

*Primary Examiner*—Richard J. Apley
*Attorney, Agent, or Firm*—Karl F. Ross

[57] ABSTRACT

A target pigeon is made of high-impact material, formed with a ring-shaped hub spanned by a cross-member and a circular wall having a convex outer face and provided with a level bottom edge and with an uneven top edge. The maximum height of this wall coincides with the location at which the hub is connected with two flying wings of the propeller-type, from which location the wall height diminishes circumferentially. A cap is detachably connected to the upper edge of the hub. The cap has a cylindrical skirt the lower edge of which follows the uneven pattern of the top edge of said hub. Ties may be provided between the hub and the cap in order to allow for the detachment of the cap from the hub, when a shot strikes the cap, but suitable to prevent their complete separation. The cap is connected to the hub by means of at least two legs carried by the cap and a corresponding number of slots formed in the hub, easy-disconnection contact surfaces being provided therebetween. The pigeon is thus capable of being recovered following the shooting and the cap to be reconnected with the hub, in order for the pigeon to be repeatedly launched, fired and recovered.

26 Claims, 19 Drawing Figures

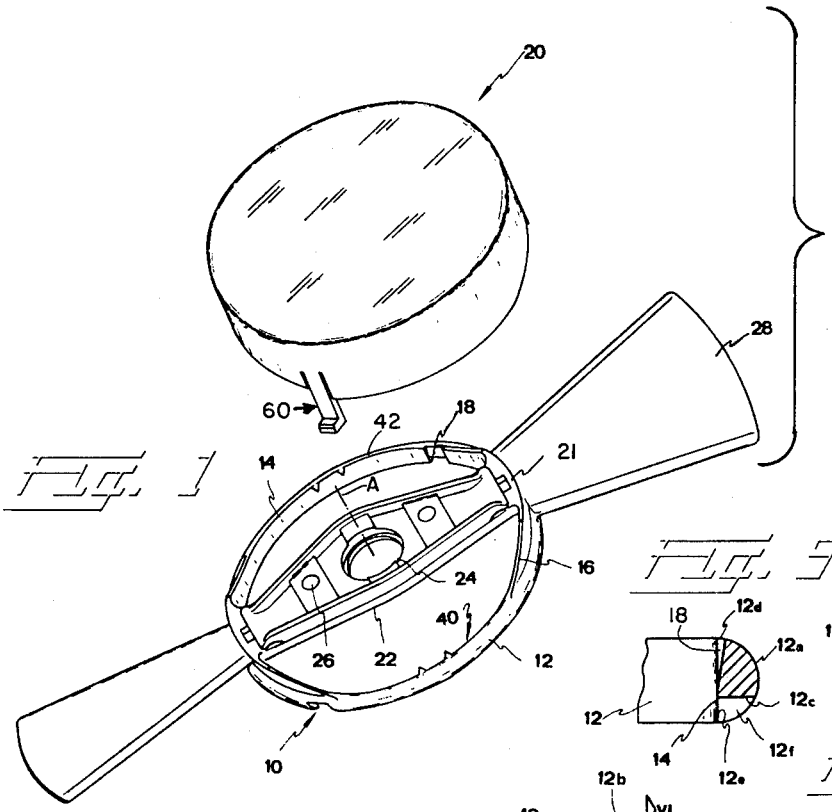
Fig. 1
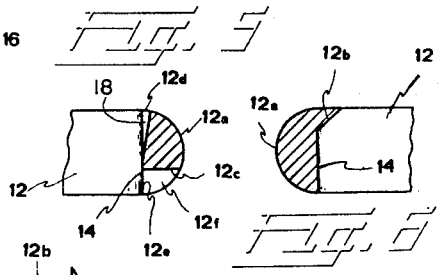
Fig. 5
Fig. 6
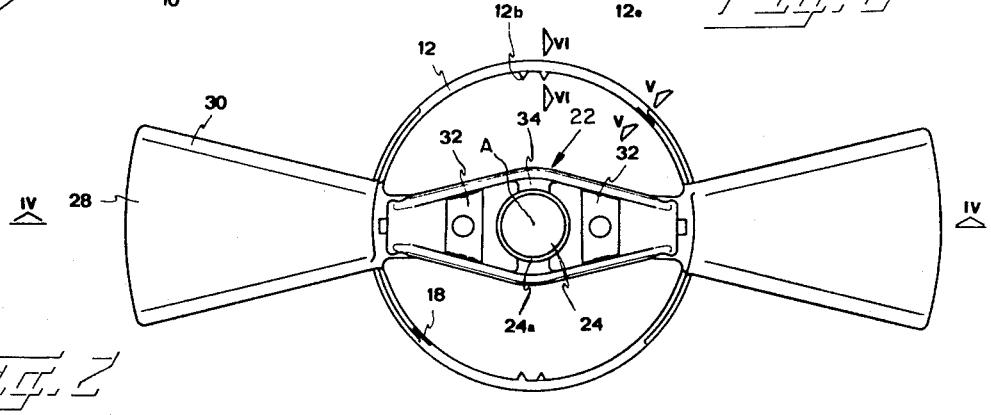
Fig. 2
Fig. 4
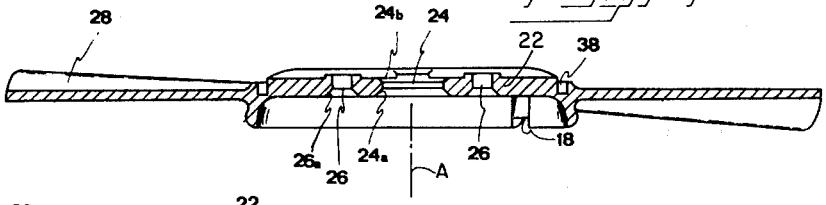
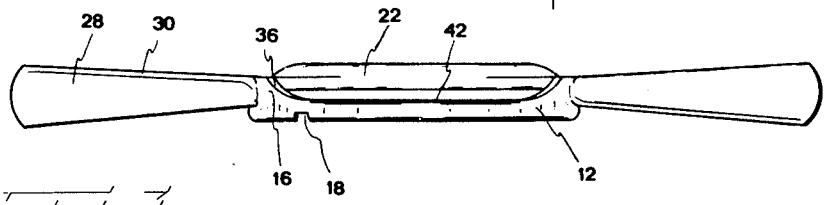
Fig. 3

FLYING TARGET PIGEONS

CROSS-REFERENCE TO RELATED APPLICATIONS

This is a continuation-in-part of my copending applications Ser. No. 604,069, filed Aug. 12, 1975, now abandoned, Ser. No. 679,135, filed Apr. 21, 1976 (now U.S. Pat. No. 4,077,384), and Ser. No. 762,019, filed Jan. 24, 1977 now U.S. Pat. No. 4,133,532.

BACKGROUND OF THE INVENTION

1. Field of the Invention

This invention relates to trap shooting. More particularly, the invention relates to a target pigeon suitable to simulate the flight of a living bird during shooting events. Still more particularly, the invention relates to an improved target pigeon capable of being recovered and re-used.

2. The Prior Art

In trap or target-pigeon shooting a target pigeon is launched into the air to simulate a bird being flushed from cover, and the shooter, usually armed with a shotgun, fires at this target to improve his abilities for actual wing shooting. In order to maximize the effectiveness of such a practice, it is necessary that the trap or target pigeon be launched into the air in a manner closely resembling a bird on the wing. Furthermore, there are many different behavior patterns in game birds, and it is therefore necessary that the pigeons be capable of duplicating various random flight patterns.

In my above identified patent applications, I have disclosed a target pigeon of the type to which this invention is related, which comprises a cap and a propeller-hub in form of a ring. This pigeon is at least in part made of frangible material so as to break when hit by shot with a resultant operation of the cap from the hub, so as to clearly show that the target was in fact reached by the shots of a shooter. This breakage, and the consequent separation of hub and cap result in the falling down of the target portions in a way which closely resembles the behavior of a live bird that has been hit.

The target pigeons of my prior applications are provided with a multi-stepped cap; the purpose of the steps being mainly to provide weakened zones to expedite breaking-apart of the cap when a shot impinges thereon, and also to provide stabilizing means for a steady flight of the assembly (i.e. target pigeon). There were also provided snap portions at the lugs connecting the cap with the hub, in order to produce disengagement of these (and consequently the separation of cap and hub) even in the case of an impact which is per se not strong enough to produce the desired break-up, so as to obtain an assured separation of the cap from the hub under all circumstances.

The circular wall of the hub was given a substantial height, in order to increase the surface area over which the pigeon would receive a direct shot impact, with the purpose of either attaining the breakage of the ring or to transfer the impact force to the snap portions of the legs so as to dislodge these from the corresponding slots of the ring to obtain separation of the cap from the hub.

Of course, the pigeons according to my prior proposals were always destroyed when the shooter was "on target". This meant replacement costs for new pigeons and it could happed that, due to a miscalculation of demand for a particular shooting event, the stock of pigeons was used up prematurely, thus brining the shooting event to an early end.

In the meanwhile I have discovered that the pigeons can be made re-usable, by making both the hub ring and the cap from non-frangible, high-impact materials, and interposing a tie means between the cap and the hub, in order to avoid the complete separation of the two pieces when they become disengaged one from another upon being impacted by shot. When such a pigeon is hit the even flight of the pigeon is changed into a fluttering falldown, closely resembling that of a drying bird, and indicating that the target was hit by the shooter. Of course, certain changes were necessary in the structure of both pieces, so as to counteract the more rigid structure of the connecting elements, maintain the snap-action thereof, and to make both pieces strong enough to resist the shot impact, as well as the knock-down shock on earth, without sustaining substantial damage. A target pigeon according to the present invention can be re-used several times, with consequent savings in material costs, manufacturing operations, time and labor, all of which results in a lesser price-per-shoot for the sportsman. Furthermore, the possibility that the pigeon stock might run out during a shoot is sharply diminished.

SUMMARY OF THE INVENTION

It is, therefore, an object of the present invention to provide an improved target pigeon which is capable of being re-used repeatedly. The improved target pigeon is to be made of substantially non-frangible, high-impact materials.

Another object of the invention is to provide a greater target surface on the cap piece of the pigeon, in order to expedite the detachment of the two pieces from one another upon being hit by a shot.

A further object of the invention is to provide an "easy-document" means between the cap and the hug ring, capable of snapping out of the connecting condition when a shot impact is received on any place of the cap, either in form of a direct impact or as a skewed impact.

A concomitant object of the invention is to provide specifically designed connecting legs on the cap, which are suitable for cooperation with specially designed slots provided on the ring, and which function at the low elastic coefficient of the material of the target.

Still another object of the invention is to provide a tie means between the cap and the hub ring which permits the two pieces to become detached from one another when impacted by a shot, but without allowing their complete separation from one another.

Yet a further object of the invention is to provide the hub ring with a convex outer face so as to deflect impacting shot to the cap an to avoid direct (i.e. non-oblique) impact of shot on the ring, which could result in damage to the ring.

These objects are attained according to the present invention in a flying target pigeon having a hub centered on a pigeon axis and carrying means suitable to cooperate with launching means provided on a launch apparatus which launches the pigeon into the air. The hub has a pair of radially extending flat wings which are inclined propeller-fashion to the hub and to each other. The hub also has a circular wall centered on this axis; this wall is provided with an outer convex face and has its bottom edge planar whereas its top edge follows a sinous pattern, so as to reduce the height and surface area of the circular wall. A cap piece is provided having a surface area which is increased in a measure corresponding to the decrease of the surface area of the wall, and which is provided with specially designed legs extending downwardly to cooperate with internal notches formed in the circular wall. The legs and the notches are provided with easy-disconnect contact surfaces for disengaging the legs from the notches upon a shot impact on the cap. Optionally, but not obligatorily, a tie means may be provided between the hub and the cap, which permits disengagement of the legs from the notches upon a shot impact, so that the two pieces become detached, but which prevents the complete separation of the two pieces. These features provide for a re-usable, high-impact pigeon capable of being launched an indefinite number of times, and which is arranged to provide positive visual evidence of an impact thereon.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is an exploded perspective view, showing the two pieces of a target pigeon according to the present invention;

FIG. 2 is a top plan view of the propellered hub ring of the pigeon;

FIG. 3 is a side elevational view of the hub ring in FIG. 2;

FIG. 4 is a vertical section of the hub ring taken on the line IV—IV of FIG. 2;

FIG. 5 is a partial cross-section of the hub ring wall, taken on the line V—V of FIG. 2;

FIG. 6 is a fragmentary cross-sectional view of the hub ring, taken on the line VI—VI of FIG. 2;

FIG. 15 is a partially broken-away, partly section top view of the cap shown in FIG. 14, illustrating the anchoring means for the tie means;

DESCRIPTION OF THE PREFERRED EMBODIMENT

Figure 7:
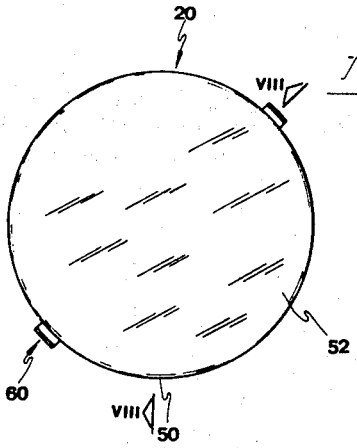
FIG. 7 is a top view of a first embodiment of the cap as shown in FIG. 1.

Referring firstly to FIGS. 1–4, the pigeon disclosed therein is composed of a hub piece generally designated with reference numeral 10, and a cap piece generally designated with reference numeral 20. The hub piece is comprised of a ring 40 and a cross-member 22 which extends diametrally inside the ring 40. The cross-member 22 is provided with a central hole 24 which is adapted to fit over the launching tip of a launch apparatus, and also with a pair of spaced apart holes 26, each adapted to cooperate with the rotation-imparting pins of the apparatus which is disclosed in my application Ser. No. 679,135 the contents of which are herein incorporated. Wings 28 extend radially outwardly from the ring 40, and are each provided with beveled side edges 30. These wings 28 are each tilted relative to the ring 40 in propeller-fashion so that when the pigeon is spun about the axis A defined by hole 24, it will displace itself axially through the air.

At the area immediately adjacent to the wings 28, the height of ring 40 increases, as shown at 21, in relation to the bottom edge of the ring which extends substantially level. This higher portion 21 merges circumferentially into a short downwardly sloping portion 16 which in turn merges into a substantially circumferential portion 12 of reduced and uniform height. The entire ring 40 is also provided with an outer convex face **12*a* having a half-round cross-section (FIGS. 5–6). The radius of curvature of this half-round face is equal to about one-half the height of the ring at the portions 12 (FIGS. 5–6). Thus an important decrease in the total surface area of the ring 40 is provided, and furthermore a shot-diverting outer surface 12*a* is formed so that, when a shot impinges thereon, the shot is deflected upwardly to the cap 20 which is located about the ring 40**, or else downwardly into an out-of-impingement trajectory.

FIGS. 5 and 6 show a profile of the ring 40, taken on the line V—V of FIG. 2, to illustrate the shape of a slot 18, and VI—VI of FIG. 2, to show the shape of an abutment **12*b*. Two (or more) of the slots 18 are angularly equispaced about the circumference of ring 40 (FIG. 2), in order to cooperate with a corresponding number of legs 60 which are provided on the cap 20, to be discussed later. The abutments 12*b* are formed internally as radially inwardly top projections of the inner face 14 of ring 40, as shown in FIG. 6**.

According to a first embodiment the slots 18, carried on the portions 12 of ring 40, are provided as internal undercuts at the inner face 14 and are so formed that a completely semi-circular section is obtained for a land limited by the inner face 14 and the outer round (convex) face **12*a* (FIG. 5). The half-round portion terminates in downward direction at a horizontal straight surface 12*c*. Thus, a lower undercut portion 12*f* is formed which is limited in upward direction by the horizontal surface 12*c*, and in rearward direction by a lower portion 12*e* of the internal face 14. The triangle-shaped land 12***d* thus formed has a rearward slant, directed upwardly and outwardly, in order to facilitate sliding of a cooperating foot of a leg 60, when dislodged, from under the triangle-shaped land 12*d*.

Figure 17:
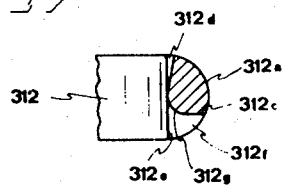
FIG. 17 is an enlarged view, partially in section, corresponding to FIG. 5 but showing a different notch pattern.

An alternative embodiment of this slot is shown in FIG. 17 wherein the half-round outer face is designated by reference numeral 312*a*, the lower undercut by numeral 312*f*, the rear lower portion by numeral 312*e* and the rear slant by numeral 312*d*. The difference between the embodiment of FIG. 5 and the embodiment illustrated in FIG. 17 is that the horizontal surface 312*c* is formed with its rear corner rounded, as at 312*g*, in order to additionally help in the snap disconnection of a leg that will follow this round corner and then will snap through the rear slant, thus providing a still easier detachment of the cap from the ring.

Figure 12:
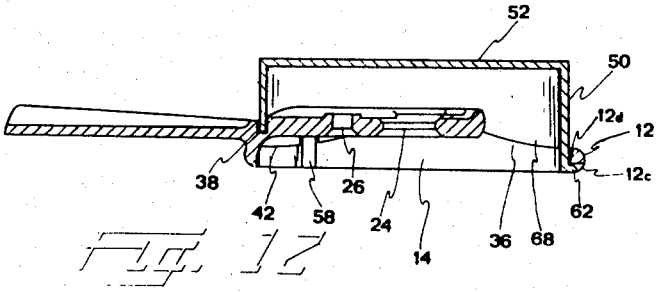
FIG. 12 is a vertical section showing the pieces of FIG. 1 in assembled condition, with only one wing visible.
Figure 13:
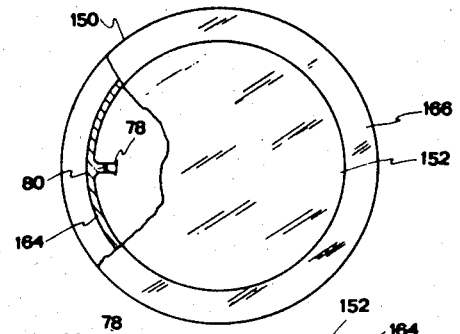

Returning to FIGS. 2, 3, and 4, it will be seen that the cross-member 22 extends at a substantially higher lever than the upper edge 42 of the lower (i.e. shallower) even portions 12 of the ring (FIG. 3). This edge 42 originates at the short downwardly curved edges 36 of the intermediate-height portions 16. Portions 32 of the cross-member 22 carry holes 26, each with a lower flaring (i.e. divergence) 26*a*. The central portion 34 of member 22 has its central hole 24 with a lower flaring 24*a* and an upper flaring 24*b*, in order to facilitate the separation of the pigeon from the launching apparatus. At the highest portions 21 of the ring 40, there are provided recesses 38 (FIG. 4), suitable to receive small projections (64 in FIG. 8; 164 in FIGS. 9 and 16) of the cooperating cap 20, in a rotation-transmitting relationship. This interaction is shown in FIG. 12.

The purpose of decreasing the total surface area of the ring 40 is to provide a corresponding increase in the total surface area of the cap 20 without increasing the overall height of the pigeon since, due to the high impact resistance of the materals now employed, it is intended that neither the ring 40 nor the cap 20 be destroyed, when a shot impact is received on the cap, when the pigeon is flying as a target. There are only to become detached.

Figure 10:
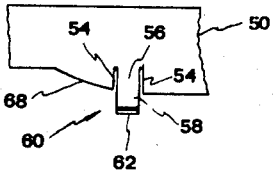
FIG. 10 is an enlarged fragmentary view of the cap, showing a connecting leg thereof.
Figure 11:
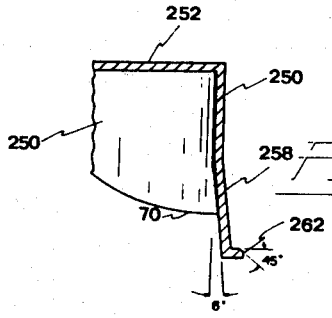
FIG. 11 is a fragmentary, enlarged vertical section of the cap in FIG. 7, but showing a different type of leg.

A first embodiment of the cap 20 will now be discussed with reference to FIGS. 7, 8, 10 and 11 wherein the cap 20 will be seen to be generally cylindrical, having a top end which is closed by a flat circular wall 52 the diameter of which corresponds to the diameter of the ring 40. A side cylindrical wall 50 depends from wall 52, and its lower edge is shaped in a pattern generally corresponding to the up-and-down pattern of the top edge of the ring 40. Thus, a shorter (in vertical direction) portion, shown as the intermediate portion in FIG. 8, from which extends the projection 64, merges circumferentially into a progressively higher portion 68 which defines a curved lower edge and ends in a highest portion 70 (FIG. 11). Approximately at the portions 70 the cap 20 is formed with a pair of grooves or slots 54, extending axially in parallelism with each other. Between the grooves 54 there is thus formed a depending leg, generally designated with numeral 60 in FIG. 7. Due to the fact that this leg is provided at the highest portion 70 of the cyclindrical wall 50, the length of the portion 58 of leg 60 which extends beyond the lower end of portion 70 is relatively small. This leg 60 would therefore not be able to yield sufficiently to provide the snap action necessary to connect it with the respective notch 18, and to snap out of the notch 18 upon impact by a shot, so as to provide for detachment of the cap 20 from ring 40. That is why the grooves 54 are provided which carry the root portion 56 of the leg 60 upwardly, well into the middle of the portion 70 of the cylindrical wall 50. It is preferred that the upper ends of these grooves 54 be arched, in order to avoid the formation of cracks therein due to the encountered bending stresses (i.e. the upper ends are not square but semi-circular). Due to the provision of the grooves 54 each leg 60 will have a total length sufficient to provide the yielding necessary for the function mentioned above.

Figure 8:
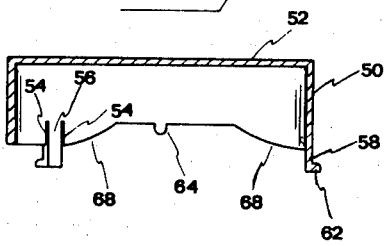
FIG. 8 is a vertical section of the cap, taken on the line VIII—VIII of FIG. 7.
Figure 9:
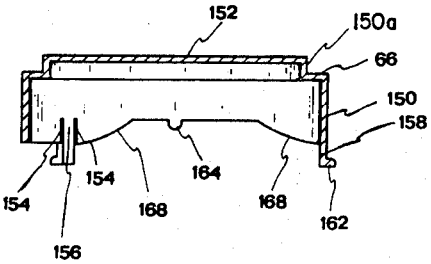
FIG. 9 is a view corresponding to FIG. 8, but showing a second embodiment of the cap.

A second embodiment of the cap 20 is shown in FIG. 9. All portions corresponding to those in FIG. 8, are designated with similar reference numerals but have the prefix one. The embodiment of FIG. 9 differs from the one in FIG. 8 in that the cap 20 has a step 66 at the top end of the cylindrical wall 150 which serves to reduce the original diameter of the wall 150 to a substantially smaller diameter. Additionally, step 66 ends inwardly in a cylindrical portion 150*a*, which projects upwardly to the circular horizontal wall 152.

I have discovered that a target pigeon can fly almost as well with a stepped cap as with a cylindrical one. It has been found that if the cap has one step a certain air disturbance is formed during the flight of the target and that this air disturbance helps to obtain a more erratic flight path. On the other hand, a completely cylindrical cap, such as shown in FIGS. 1, 7 and 8, can better follow the "spin" imparted by the launch apparatus to alter the original trajectory of the target. Additionally, in a completely cylindrical cap there is no loss at all of surface area for a shot to impinge upon, whereas there is some loss of impingement area that is located behind the outermost corner of the step on a stepped cap due to the rebound of a shot thereon in a highly skewed trajectory. The second cap embodiment shown in FIG. 9 is best suited for use with a further embodiment of the target pigeon, to be discussed with reference to FIGS. 14–16.

Figure 13:
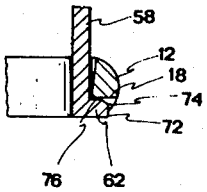
FIG. 13 is an enlarged, partly sectioned detail view, illustrating the connection of a leg as shown in FIGS. 8–10 within a corresponding notch.

In both embodiments (FIGS. 7, 8, 10 and 11 and FIG. 9), a like leg construction is employed. This leg 60 or 160 carries, at the end thereof a radially outwardly extending foot 62 or 162. These legs have their protruding portions 58 or 158, coplanar with the wall portion from which they depend. In a first embodiment, the foot 62 forms a straight angle to the leg, and the upper outer corner of the foot is chamfered, as shown at 74 (FIG. 13), between a substantially horizontal upper wall 76 and an end wall 72 of the foot. The purpose of this is to provide a minimum contact area with the lower face 12*c* (FIG. 5) bounding the slot, in order that a small impact force suffices to snap the entire foot from under the wall 12*c*, to provide for detachment for the entire cap 20 from the ring 40. For further details on the chamfer 74, reference is made to my copending application Ser. No. 762,019, the disclosure of which is incorporated herein by reference.

Figure 18:
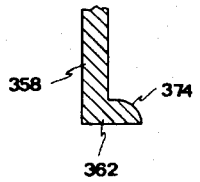
FIG. 18 is a vertical cross-sectional view of a leg suitable to be used with the notch shown in FIG. 17.

FIG. 18 shows a second embodiment of the foot which is identified in this Figure by reference numeral 362. Instead of an upper horizontal wall 76 and an end wall 72, with an intermediate chamfer 74, foot 362 is provided with a lower straight face and an upper face of mixed contour which only provides a small portion, immediately adjacent to leg 358, of straight surface. This portion is preferably equal to about one-thrid of the thickness of the ring 40, at the slot 18. The remaining portion of the foot is round, as shown at 374, so as to define a more easily disengageable foot. Although this embodiment of the foot 362 can be used with a ring 40 provided with the first embodiment of the slot 18, as illustrated in FIG. 5, it is more suitable for use with the above-discussed second embodiment depicted in FIG. 17.

Figure 19:
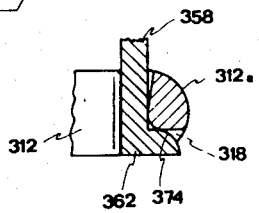
FIG. 19 is an enlarged sectional detail view corresponding to FIG. 13, but showing the engagement of the FIG. 18 leg with the FIG. 17 notch.

As shown in FIG. 19, these two connecting means provide only a slight point of contact, and the round cooperating portions thereof make the disengagement and the concomitant detachment of the cap from the ring extremely easy, there being needed only a small force to snap the foot 362 from the slot 318. Parts in FIGS. 17, 18 and 19 similar to those of FIGS. 5 and 8, 10, carry similar reference numerals, but with the prefix three.

Either of these two embodiments of the foot at the end of the leg, can be used with a further embodiment of the leg, which is shown in FIG. 11. Parts of this Figure similar to those of FIGS. 7, 8, 10 are identified by similar reference numerals, but with the prefix two. The difference between the leg 258 of FIG. 11 and the leg 58 of FIG. 8 is that the former is not coplanar with the wall portion 250 but extends diagonally outwardly and downwardly. For details about this type of leg may be found in my above identifed copending application Ser. No. 762,019, the disclosure of which is incorporated herein by reference.

The cooperation between the cap and the hub of the target of the first embodiment of this invention, is shown in FIG. 12. It should be noted that although the completely cylindrical cap 20 has been shown here, the same cooperation could be obtained with the stepped embodiment of the cap which is shown in FIG. 9. The same is true with respect to the type of leg provided on the cap 20, and with respect to the type of foot provided on the leg. Also, the slots 18 of the ring 40 could be of any one of the types shown in FIGS. 5 and 17. The result will be more or less the same.

The cap 20 is seen in FIG. 12 to be carried on the hub 10 so that the guide protrusions 64 correspond with recesses 38, taking care that legs 60 enter into the ring. When the final assembled position is reached, the foot portions of the legs will "click" into position within the slots 18 and, at the same time, the protrusions 64 will enter the recesses 38, while the extensions 12*b* (FIG. 6) will engage the lower edge of the cap to avoid misalignment. The curved portions and the straight portions of both edges thus merge and interengage as shown in the drawing.

Once this assembly operation is completed, the target pigeon is ready to be connected to the launching head of a launch apparatus, in order to receive a high speed rotational movement, sufficient to reach a selfsustained flying condition. This rotation is transferred from the hub to the cap through the cooperating protrusions and recesses. In this condition, the pigeon is released from the launching tip and starts flying. A shooter, generally carrying a shotgun, aims at the target and fires his weapon. If some of the shot impinges on the target, the result will be a detachment of the cap from the ring, whereby a clear indication of a positive hit is obtained. This detachment is produced, irrespective of whether a shot impinges directly on the cap or whether a shot rebounds from the convex outer face of the ring onto the cap. When either type of impingement occurs, the force of the impingement carries the foot portion of at least one of the legs out of its corresponding notch due to the sliding cooperation of the surfaces thereof. Upon disengagement of one foot from its notch, the wind force, the speed of rotation and the "spin" created by the disengagement itself, assure that the remaining leg or legs become disengaged from their corresponding notches, thus producing the desired complete separation of cap and hub.

As stated before, it is desirable that the target pigeons of this invention can be re-used. To make this possible, it is necessary that the materials for the manufacture of both pieces are durable and strong enough to resist the shot impacts and the shock forces of the knock-down to earth, without any or at least without any major damage. Materials suitable for making a pigeon capable of meeting these requirements include—but are not limited to—high-density polypropylene, high-impact titanium alloys, high-impact nylon, polycarbonates, stainless steel, Duraluminium, Lexan, or any other high-impact material.

With the above discussed pigeon, shown in assembled condition in FIG. 12, it is highly likely that the separation of cap and hub will result in one of these pieces, usually the propellered hub 10, falling to the ground at a location far removed from the other piece, to wit, the cap. This may mean that one of the pieces could become lost or entangled in tree foliage, or the like. At the very least, an extended search for both pieces is likely to be required. In order to avoid this, a complete separation of both pieces should desirably be prevented. For this purpose a modified target pigeon is provided, which includes tie means capable of retaining the two pieces in a detached, but still loosely connected condition, following the shot hit above discussed.

Figure 14:
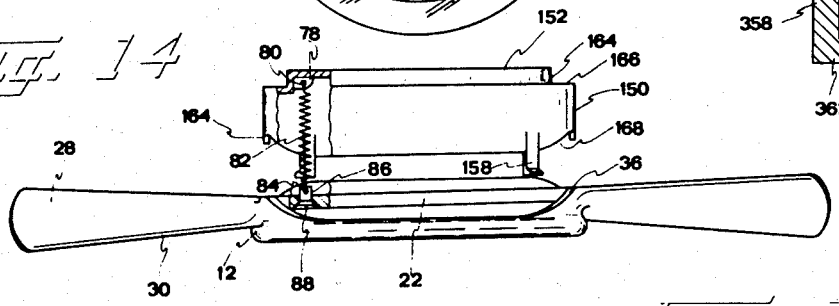
FIG. 14 is a partially sectional, partially broken-away side view of another embodiment of the target pigeon shown in detached condition, illustrating a first type of tie means connecting the hub ring and the cap.
Figure 16:
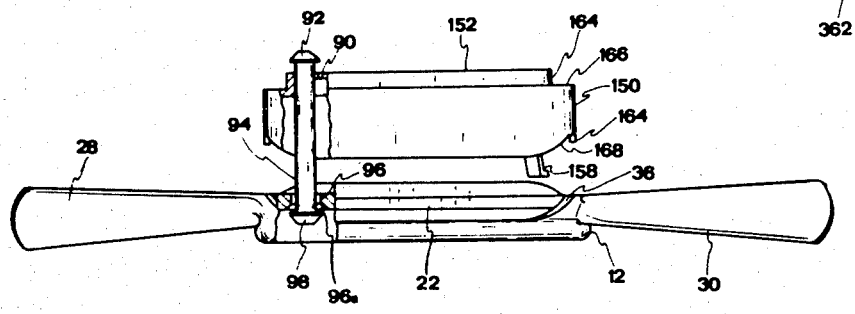
FIG. 16 is a view corresponding to FIG. 14, showing a second type of tie means connecting the hub ring and the cap.

This modification shown in FIGS. 14, 15 and 16 wherein parts similar to those shown in FIGS. 1, 2, 3, 4, are identified with similar reference numerals, and parts similar to those shown in FIGS. 8, 9, are also identified by similar numerals.

In the embodiment of FIGS. 14 and 15, the type of cap depicted in FIG. 9 is employed. This cap is provided at its inner corner formed between the vertical wall 150*a* and the top circular wall 152, with a lug 78 which extends internally and has a throughgoing hole 80. One end of a spring 82 is anchored in the hole 80; the spring extends downwardly to a second hole 84 formed in a vertical shank 86 of the cross-member 22, as shown at 88, which hole 84 is located vertically below the hole 80 of the leg 78.

In the FIG. 16 embodiment, the type of cap depicted in FIG. 9 is again employed. Here, the cap is provided in its top wall 152 with a vertical hole 90, through which the upper emnd of a tie bolt 94 is passed which is provided with an enlargement 92 to prevent the withdrawal of the upper end from the hole 90. The lower end of bolt 94 passes through a similar hole 96, formed in the cross-member 22, and a similar enlargement 98 is provided on the lower end to anchor the same to the cross-member 22. It goes without saying that the two holes 90, 96 are again vertically aligned and that the length of the bolt 94 is greater than the distance between the lower face of the cross-member 22 and the top wall 152 of the cap, plus the pending length of the legs, so that the cap can snap from the engaged position shown in FIG. 12 to the detached position shown in FIG. 16, thus indicating a hit but without resulting in complete separation of the cap from the hub.

These embodiments could, of course, also be employed with the completely cylindrical cap of FIG. 8, but it is currently preferred that the stepped type be used. Also, any disclosed type of leg, provided with any type of foot, as well as any disclosed type of slot, can be employed.

It will be apparent that both in FIGS. 14–15 and in FIG. 16, the detachment of the cap from the hug will call into action the operation of the tie means 82, 94, respectively, which assure that the cap cannot become completely separated from the hub. As the tie means are in both instances located off-center relative to the central axis of the pigeon, the tie action will provide a kind of "fluttering", closely resembling that of a dying bird, which will result in a sudden interruption of the pigeon's flight, and in consequent falling-down thereof. Since both pieces remain connected by the tie means they can be picked up at the same time, and thereupon be reset into the connected position, to thus make them ready for a new launching operation.

It will be apparent that there are a number of advantages provided by the different embodiments of this invention and that these embodiments can be employed selectively and interchangeably with any of the types of pigeon. Therefore, it is intended that the appended claims cover any and all such combinations, as well as any of the features taken separately.

Furthermore, I do not wish to be limited to the details shown or discussed, since various modifications and changes may be made without departing, in any way, from the spirit of the present invention, as defined in the appended claims.

Having thus disclosed the invention, what is claimed as new and desired to be protected by Letters Patent is as follows:

I claim:

1. A target pigeon comprising:

a cup-shaped cap having a side wall centered on a cap axis and having a pair of axially opposite ends, and an end wall closing said side wall at one of said ends;

a generally flat and circular ring centered on a ring axis and having a plurality of angularly equispaced similar major side portions of predetermined relatively short axial height and a plurality of angularly equispaced similar minor side portions alternating with said major portions and of predetermined relatively long axial height;

means including interengaging formations on said ring and on the other end of said side wall for holding said cap and ring releasably together with said axes aligned and said other end of said side wall bearing on said ring and for freeing said cap and ring from each other when impacted; and respective radially extending vanes on said ring at said minor portions thereof, said vanes being tipped propeller-fashion relative to each other, said cap, ring, formation, and vanes being made of at least limitedly elastic high-impact material.

2. The target pigeon defined in claim 1 wherein said minor and major portions number two and are diametrically opposite each other.

3. The target pigeon defined in claim 1 wherein said major portions have rounded and outwardly convex outer surfaces.

4. The target pigeon defined in claim 3 wherein said outer surfaces are part circular in section.

5. The target pigeon defined in claim 1 wherein said short height is equal to at most half of said long height.

6. The target pigeon defined in claim 1 wherein said other end has a nonplanar rim and said ring has an end engageable complementarily therewith.

7. The target pigeon defined in claim 1 wherein said ring is provided with a diametrally bridging web formed at said ring axis with a throughgoing hole.

8. The target pigeon defined in claim 1 wherein said interengaging formations include at least two angularly spaced axially extending and radially deflectable legs formed on said cap and extending therefrom axially past said ring, each of said legs having a radially extending foot formed with a rounded surface turned toward said ring and bearing thereon in an assembled condition of said target pigeon, each of said rounded surfaces being slidable past said ring on axially stressing of said ring and cap away from each other to cam the respective leg inwardly and radially detach said ring and cap from each other.

9. The target pigeon defined in claim 1, further comprising an elongated tie having one end secured to said cap and another end operatively connected to said ring and of a length sufficient to permit axial separation of said ring and said cap for disengagement of said formations from each other.

10. A target pigeon comprising:

an annular ring part centered on a ring axis;

a plurality of angularly equispaced blades extending radially outwardly from said ring part and each lying in a respective plane tipped propeller-fashion to the plane of the other blade;

a witness part centered on a witness axis and having an outer periphery generally aligned with said ring part; and a plurality of angularly equispaced, axially extending, and radially deflectable legs formed on one of said parts and extending therefrom axially past the other of said parts, each of said legs having a radially extending foot formed with a rounded surface turned toward the other of said parts and in at most line contact therewith, each of said rounded surfaces being engageable with said other part on axial stressing of said parts away from each other to cam the respective leg inwardly and radially detach said parts from each other.

11. The target pigeon defined in claim 10 wherein said other part has at each end of said legs a rounded surface engaging the rounded surface of the respective leg.

12. The target pigeon defined in claim 11 wherein said legs extend from said witness part past said ring part, said witness part being a cap having an annular side wall with a pair of ends one of which constitutes said periphery, and an end wall bridging and closing the other of said ends.

13. The target pigeon defined in claim 11 wherein said feet extend radially outwardly from the respective legs.

14. The target pigeon defined in claim 13 wherein said side wall is formed to each side of each of said legs with an axially extending slot.

15. The target pigeon defined in claim 13 wherein said ring part is formed at each of said legs with a radially inwardly open groove, said feet, extending outwardly from the respective legs.

16. The target pigeon defined in claim 15 wherein said groove has a base surface inclined away from said ring axis.

17. The target pigeon defined in claim 15 wherein said ring port is formed at each of said legs with an axially open notch receiving the respective foot.

18. The target pigeon defined in claim 10 wherein said ring part has a plurality of angularly equispaced similar major side portions of predetermined relatively short axial height and a plurality of angularly equispaced similar minor side portions alternating with said major portions and of predetermined relative long axial height, said blades extending from said major portions.

19. The target pigeon defined in claim 18 wherein said major portions have rounded and outwardly convex outer surfaces.

20. The target pigeon defined in claim 18 wherein said witness part is a cap having an annular side wall with a pair of ends one of which constitutes said periphery and an end wall bridging and closing the other of said ends, said side walls being formed to each side of said legs with a throughgoing slot extending axially well past said ring part in an assembled condition of said pigeon.

21. The target pigeon defined in claim 10, further comprising an elongated tie having two ends each secured to a respective one of said parts and of a length between said ends sufficient to permit axial separation of said parts for disengagement of said legs from said other part.

22. A target pigeon comprising:

an annular ring centered on a ring axis;

a plurality of angularly equispaced blades extending radially outwardly from said ring and each lying in a respective plane tipped propeller-fashion to the plane of the other blade;

a cap centered on a cap axis and having an outer periphery generally alignable with said ring;

means including interengaging formations on said ring and cap for holding said cap and ring releasably together with said axes aligned and said periphery snugly engaged with said ring and for freeing said cap and ring from each other when impacted; and a tie constituted as a spring having one end operatively engaged with said cap and another end operatively engaged with said ring and of a length sufficient to allow axial separation of said cap and ring and disengagement of said formations from each other.

23. The target pigeon defined in claim 22 wherein said tie is flexible.

24. The target pigeon defined in claim 22 wherein said ring has a plurality of angularly equispaced similar major side portions of predetermined relatively short axial height and a plurality of angularly equispaced similar minor side portions alternating with said major portions and of predetermined relatively long axial height, said blades extending from said major portions and said minor portions having rounded and outwardly convex outer surfaces.

25. The target pigeon defined in claim 22 wherein said interengaging formations include at least two angularly spaced axially extending and radially deflectable legs formed on said cap and extending therefrom axially past said ring, each of said lets having a radially extending foot formed with a rounded surface turned toward and bearing on said ring in an assembled condition of said target pigeon, each of said rounded surfaces being slidable past said ring on axially stressing of said ring and cap away from each other to cam the respective leg inwardly and radially detach said ring and cap from each other.

26. The target pigeon defined in claim 25 wherein said ring is formed at each of said legs with a groove receiving the respective leg and having a rounded base surface engaging said rounded surface of the respective leg.

* * * * *